US006871358B2

(12) United States Patent
Galante

(10) Patent No.: US 6,871,358 B2
(45) Date of Patent: Mar. 29, 2005

(54) PREKNOTTED ADJUSTABLE FABRIC NECKTIE

(75) Inventor: John Galante, Watkinsville, GA (US)

(73) Assignee: After Six, Inc., Hackensack, NJ (US)

( * ) Notice: Subject to any disclaimer, the term of this patent is extended or adjusted under 35 U.S.C. 154(b) by 80 days.

(21) Appl. No.: 10/201,065

(22) Filed: Jul. 22, 2002

(65) Prior Publication Data

US 2004/0031084 A1 Feb. 19, 2004

Related U.S. Application Data

(63) Continuation of application No. 09/873,685, filed on Jun. 4, 2001, now Pat. No. 6,421,835, which is a continuation-in-part of application No. 09/789,425, filed on Feb. 21, 2001, now abandoned.

(51) Int. Cl.[7] ..... A41D 25/02
(52) U.S. Cl. ..... 2/149
(58) Field of Search ..... 2/144–150, 152.1, 2/153, 155–157; 24/49.1, 50

(56) References Cited

U.S. PATENT DOCUMENTS

| | | | | | |
|---|---|---|---|---|---|
| 1,396,240 | A | * | 11/1921 | Bakerman | 2/150 |
| 1,400,858 | A | * | 12/1921 | Boros | 2/150 |
| 2,040,297 | A | * | 5/1936 | Costantini | 2/150 |
| 2,553,437 | A | * | 5/1951 | Burke | 2/150 |
| 3,127,618 | A | * | 4/1964 | Roach | 2/150 |
| 3,898,698 | A | * | 8/1975 | Byrd et al. | 2/150 |
| 4,656,672 | A | * | 4/1987 | Lande | 2/150 |
| 4,694,509 | A | * | 9/1987 | Grubman | 2/144 |
| 4,897,887 | A | * | 2/1990 | Chen et al. | 2/150 |
| 5,012,530 | A | * | 5/1991 | Ackerman | 2/144 |
| 5,048,127 | A | * | 9/1991 | Yang | 2/149 |
| 6,421,835 | B1 | * | 7/2002 | Galante | 2/149 |

* cited by examiner

*Primary Examiner*—Tejash Patel
(74) *Attorney, Agent, or Firm*—Mitchell D. Bittman

(57) ABSTRACT

A preknotted adjustable necktie is provided containing no rigid materials comprising a first outer tie portion having a front wide flap segment integral with a knot segment with an opening therethrough; and a second inner tie portion having an adjustable neck embracing loop extending through the opening in said knot segment.

9 Claims, 12 Drawing Sheets

PREKNOTTED ADJUSTABLE FABRIC NECKTIE

This is a continuation of application under 37 CFR 1.53(b) of prior application Ser. No. 09/873,685 filed on Jun. 4, 2001 now U.S. Pat. No. 6,421,835 which is a CIP of Ser. No. 09/789,425 filed Feb. 21, 2001 now abandoned.

BACKGROUND OF THE INVENTION

The present invention relates generally to preknotted adjustable neckties and, more particularly to a preknotted adjustable necktie formed of fabric material and containing no rigid materials.

Heretofore, neckties were tied each time they were worn. When a necktie is tied and untied, the area where the knot is formed often becomes wrinkled or distorted. In addition, the user seldom ties the same knot each time, leading to misshaped knots. There have been at least two solutions to these problems: the clip on necktie, and the necktie having a pre-tied knot which fits around the user's neck and is adjustable by a means of a slidable zipper. Such neckties are described in U.S. Pat. Nos. 3,898,698, 4,656,672, 4,897,887 and 5,048,127. These patents generally disclose a knot portion with a rigid plate member and a neck loop with a zipper sewn in slidably attached to the knot portion to adjust the size of the loop to fit around a user's neck. However, these pre-tied neckties use rigid materials in the knot and zippers which tend to break, are uncomfortable to wear and tend to loosen during use.

SUMMARY

The present invention provides a preknotted adjustable necktie comprising a first outer tie portion having a front wide flap segment integral with a knot segment with an opening therethrough; and a second inner tie portion having an adjustable neck embracing loop extending through the opening in said knot segment, wherein the first outer tie portion and the second inner tie portion are formed of fabric material and contain no rigid materials.

The present invention also provides a process for forming this preknotted adjustable necktie by: forming from a fabric material the first outer tie portion as an elongated tie shaped strip and a second inner tie portion as a neck embracing loop; folding a top section of the first outer tie portion to form a knot cover folded over an inner knot part; attaching the corners of the knot cover together to form an oval shaped lower end of the knot segment with an opening therethrough and a bow shaped top end of the knot segment; and inserting the second inner tie portion through the opening in the lower end of the knot segment.

BRIEF DESCRIPTION OF THE DRAWINGS

Some embodiments of the invention will now be described in greater detail, with reference to the accompanying drawings in which.

DETAILED DESCRIPTION OF THE INVENTION

Figure 1:
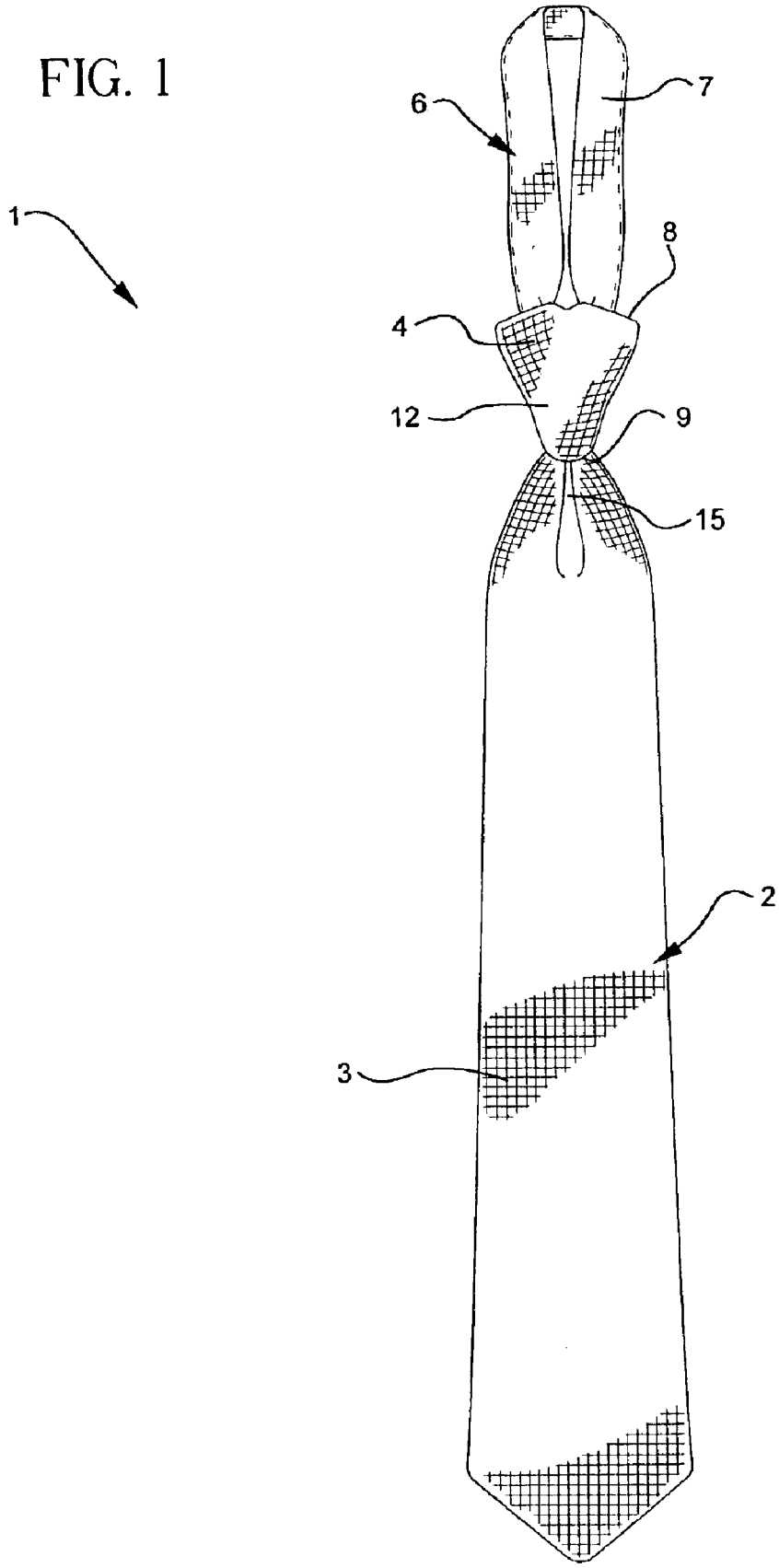
FIG. 1 is a front view of a preknotted adjustable necktie according to the invention.
Figure 2:
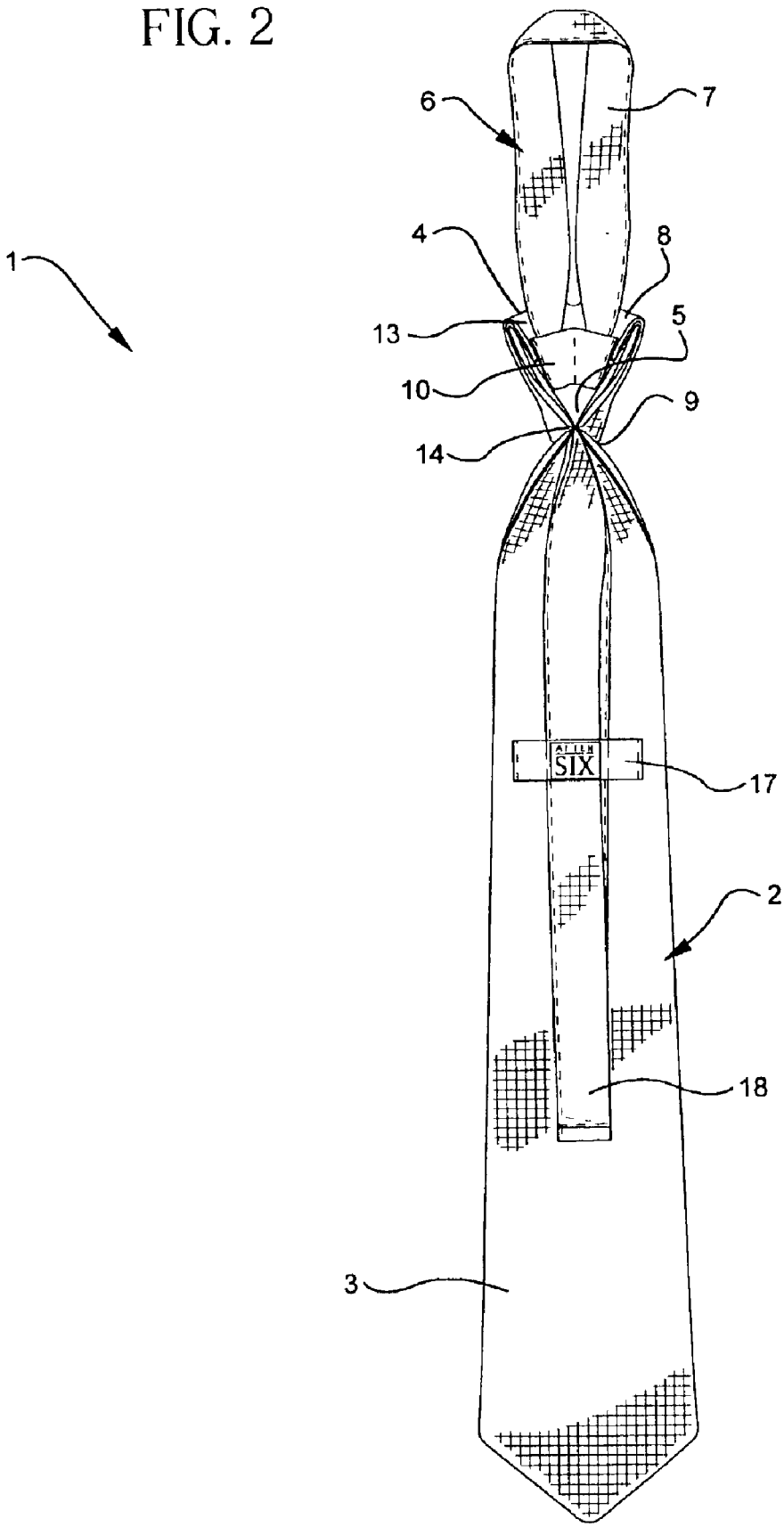
FIG. 2 is a rear view of the preknotted adjustable necktie.
Figure 2A:
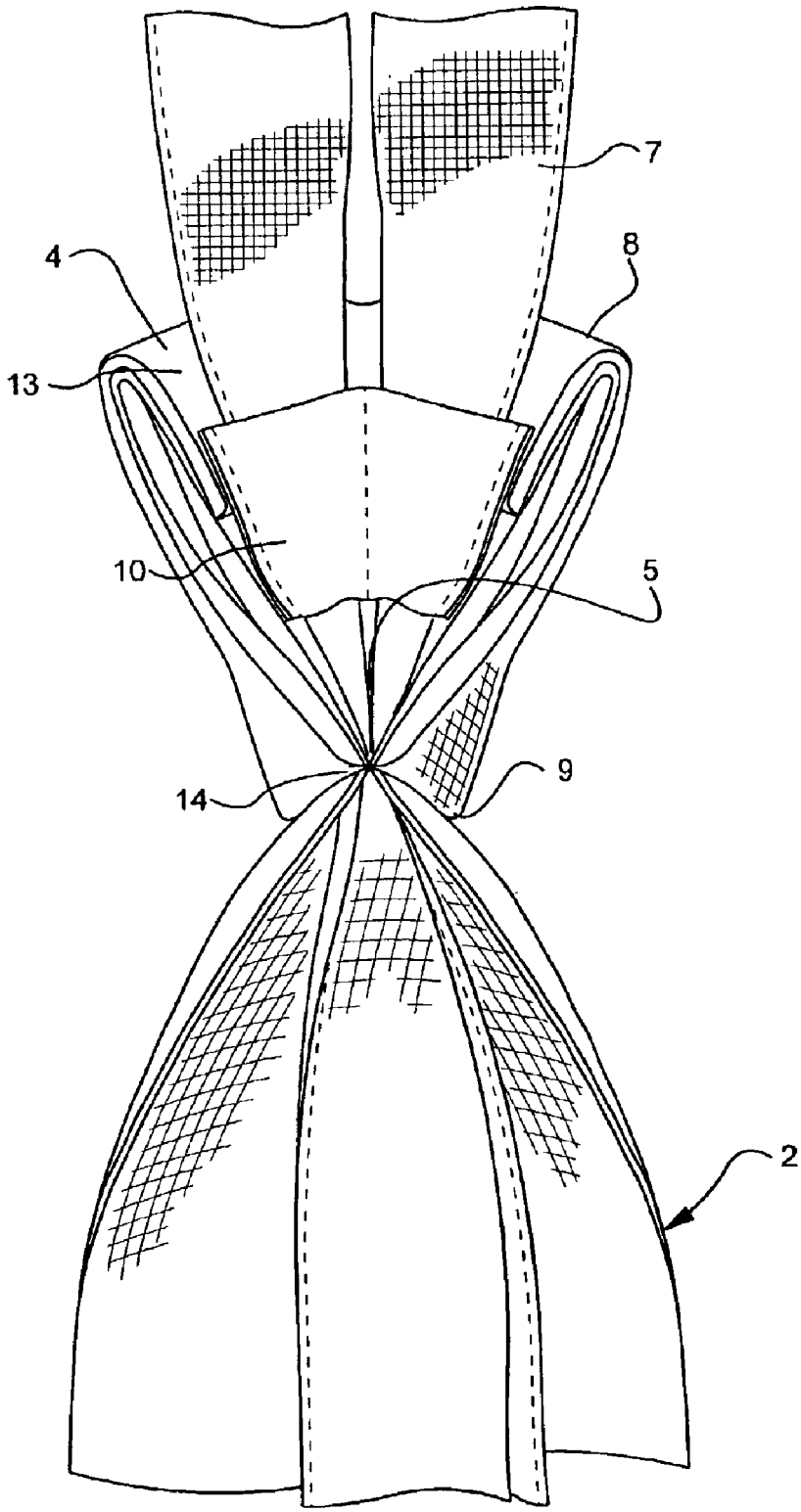
FIG. 2*a* is a partial rear view of the knot segment area of FIG. 2.

Referring to the drawings FIGS. 1 and 2 the preknotted adjustable necktie 1 has a first outer tie portion 2 having a front wide flap segment 3 integral with a knot segment 4 with an opening 5 therethrough. The front wide flap segment 3 is integral with the knot segment 4 by being made from a single piece of fabric. A second inner tie portion 6 having an adjustable neck embracing loop 7 extends through the opening 5 in the knot segment 4. The knot segment 4 has a triangular shaped front face with a bow shaped top end 8 and an oval shaped lower end 9 with the opening 5 therethrough. The necktie also has a guide loop 10 attached to the back of the top end of the knot segment 4 (ie. to inner knot part 13) for guiding the neck embracing loop 7 through the opening 5 in the knot segment.

Figure 5:
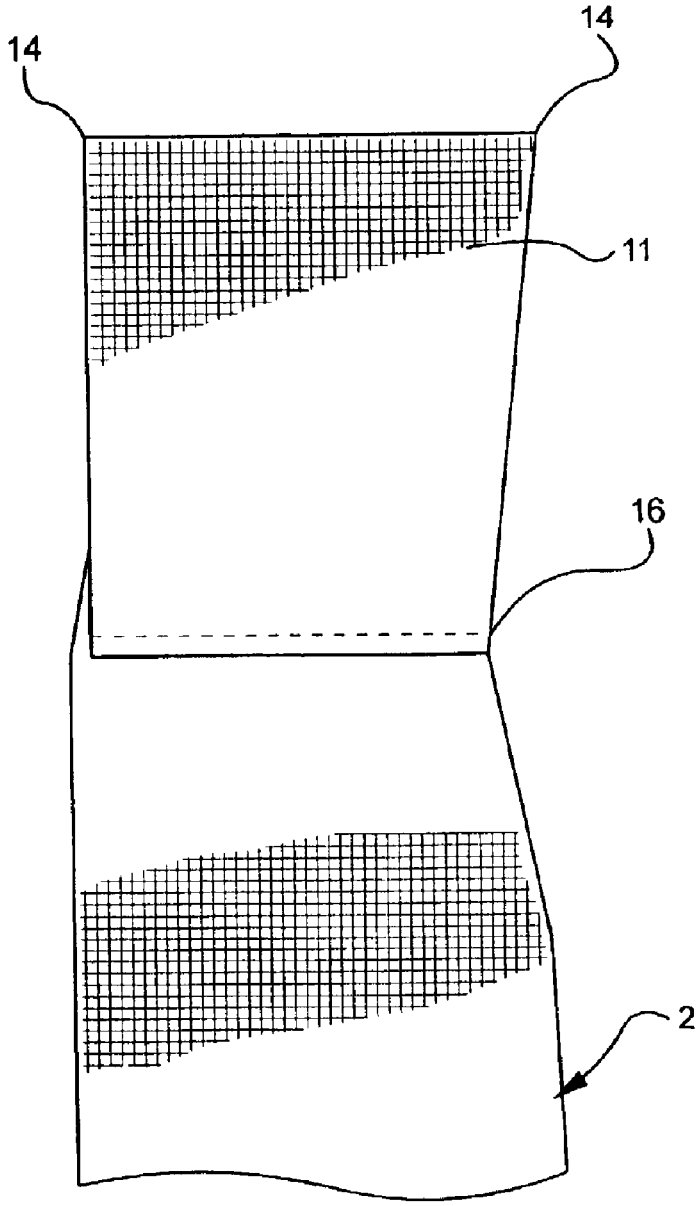
FIG. 5 is a partial rear view of the process step wherein the top part of the first outer tie portion is folded over and secured to a lower part of the outer tie portion.
Figure 5A:
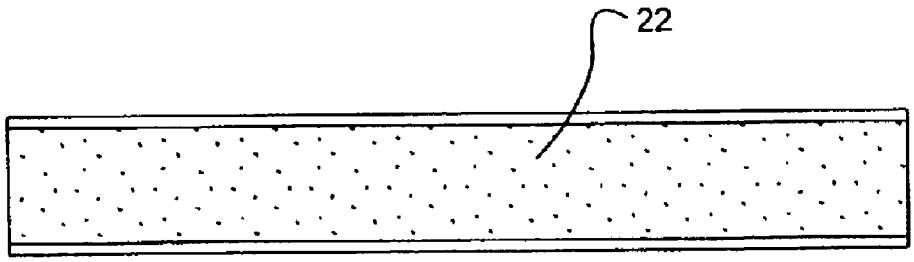
FIG. 5*a* is a front view of a guide fabric strip.
Figure 6:
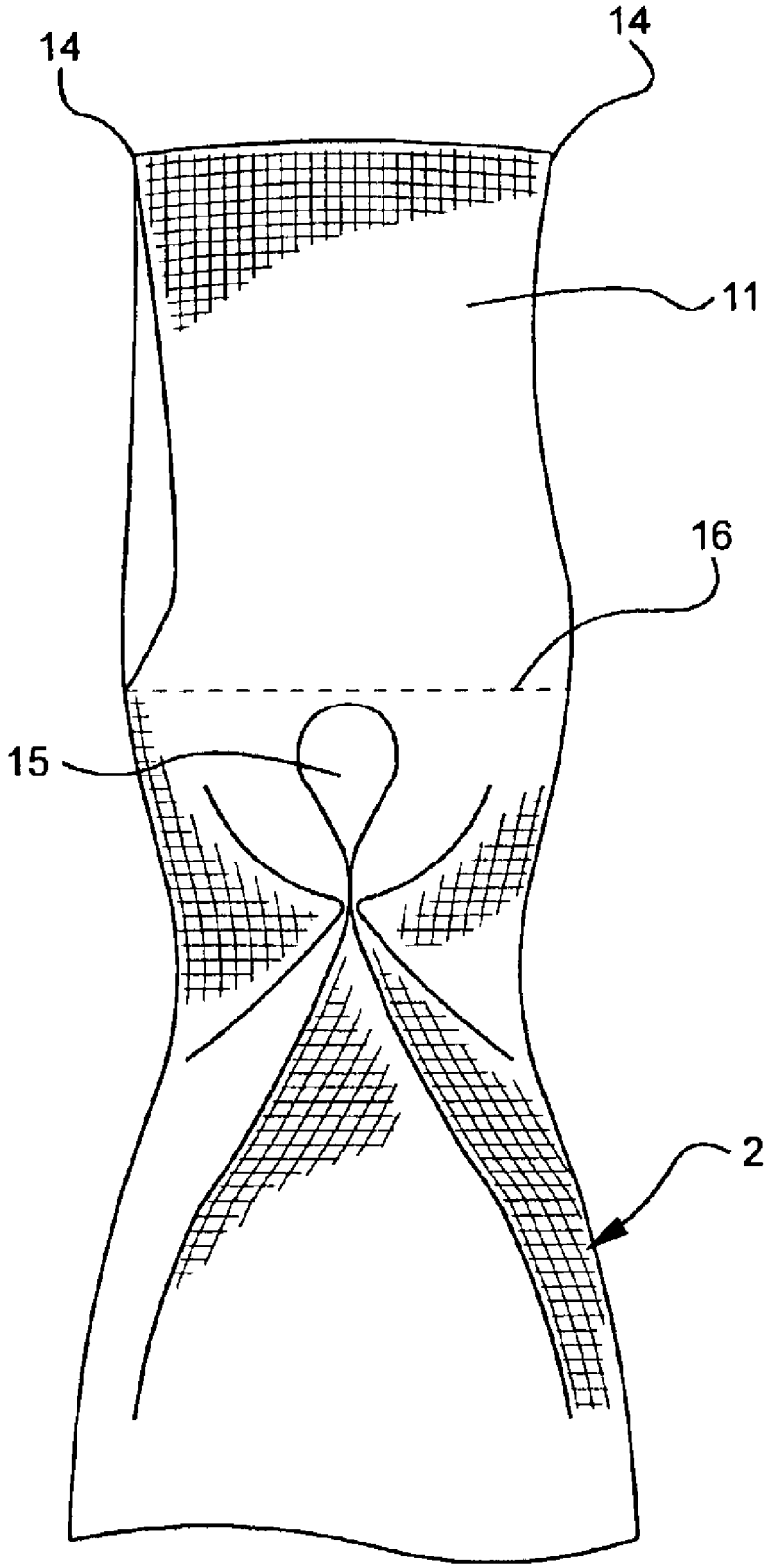
FIG. 6 is a partial front view of the process step wherein a longitudinal dimple is created in the outer tie portion.
Figure 7:
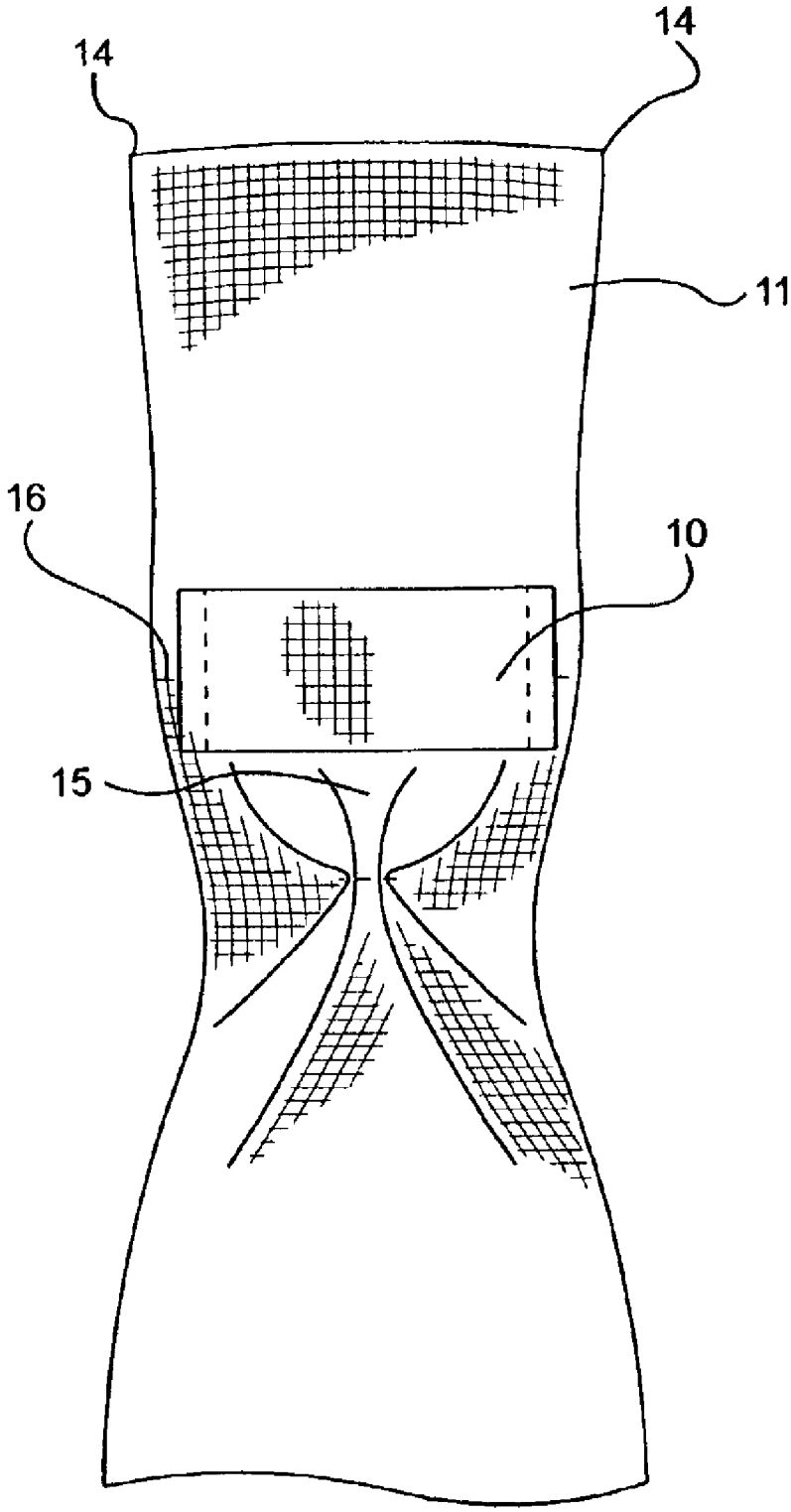
FIG. 7 is a partial rear view of the process step wherein a guide fabric strip is attached to the back of the inner knot part.

Referring to FIGS. 1, 2 and 5–11 the knot segment 4 is folded from a top section 11 of the first outer tie portion 2 to form a knot cover 12 folded over an inner knot part 13 and wherein the corners 14 of the knot cover 12 are attached together to form the oval shaped lower end 9 of the knot segment 4 with an opening 5 therethrough and a bow shaped top end 13 of the knot segment 4. As shown in FIGS. 6 and 7 a longitudinal dimple (crease) 15 is formed by stitching the fabric together below the top section 11 of the first outer tie portion 2. Preferably the corners 14 of the knot cover 12 are attached together over the dimple 15. Preferably the top section 11 is a folded top part of the first outer tie portion 2 with the folded over part being attached as per stitches 16.

Figure 2B:
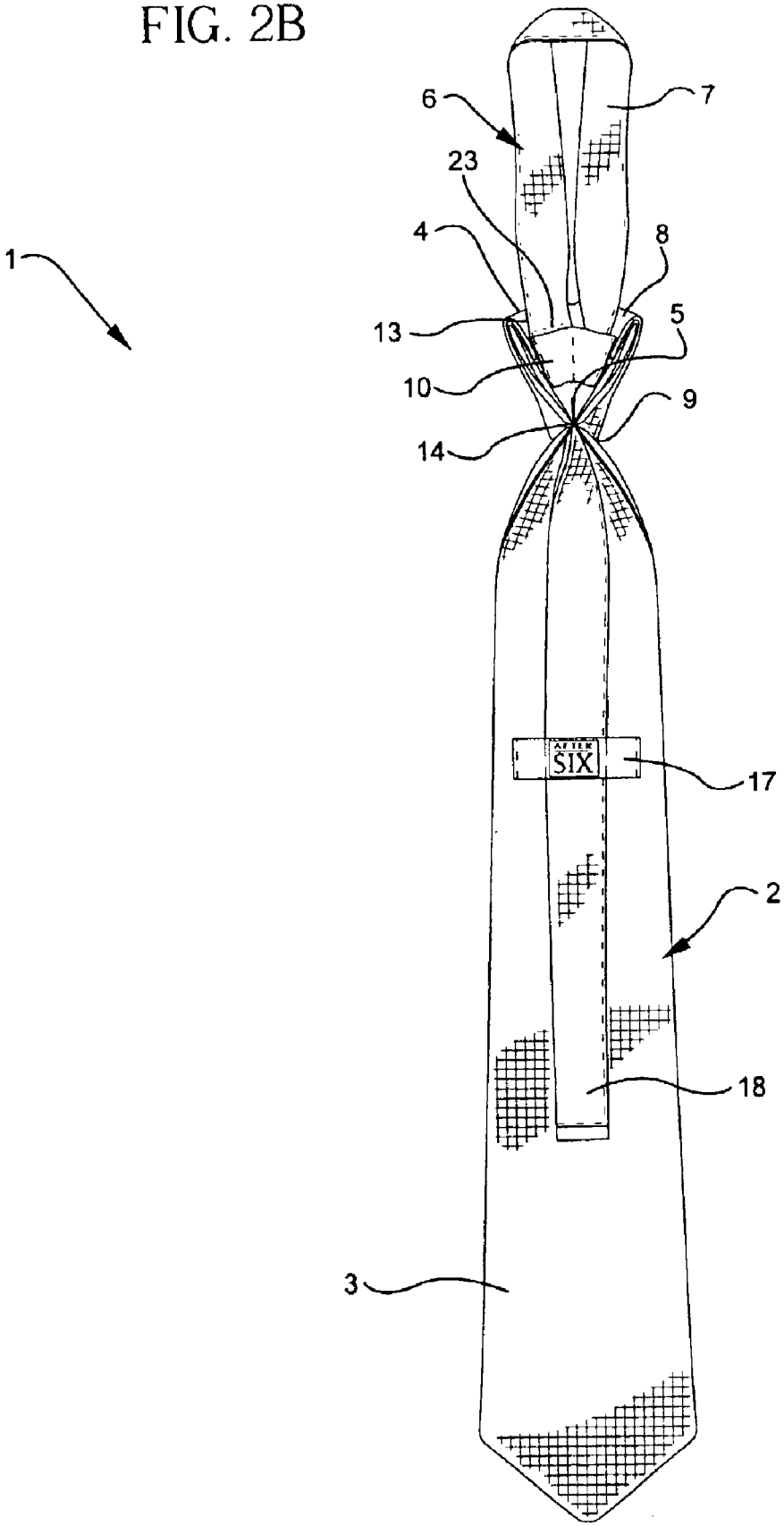
FIG. 2*b* is a rear view of an alternative embodiment of the preknoted adjustable necktie wherein one end of the neck embracing look is attached to the back of the knot segment and the other end extends through the opening in the knot segment.
Figure 3:
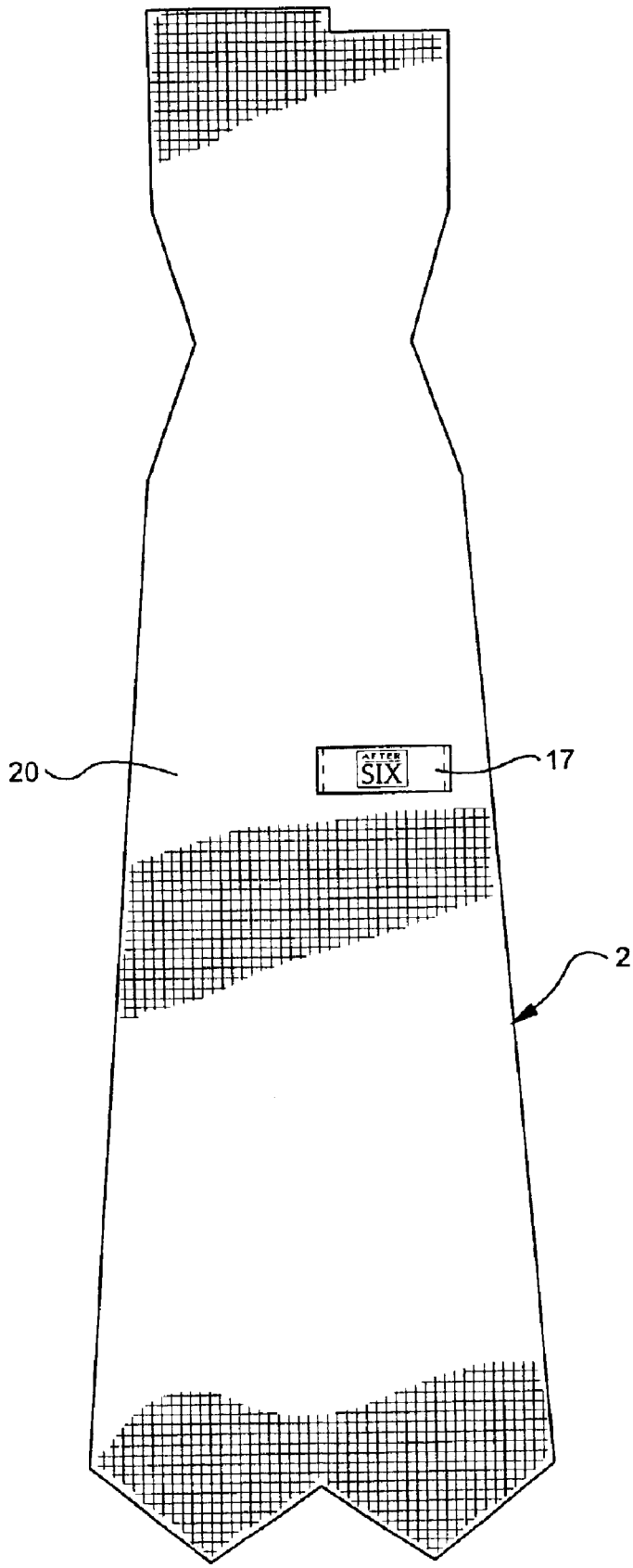
FIG. 3 is a front view of the process step wherein a pattern has been cut for forming the elongated tie shaped strip.

Referring to FIG. 2 the opening 5 in the knot segment 4 and the guide loop 10 are sized to snugly fit the neck embracing loop 7 therethrough in order to allow for manual adjustment of the position of the knot segment 4 on the neck embracing loop 7 whereas otherwise the knot segment is in a secure position on the neck embracing loop. Preferably the guide loop 10 is of a non slip fabric (eg. an elastic or rough material) to help maintain the knot segment in a secure position after adjustment. In one embodiment as shown in FIG. 2 the lower ends 18 of the neck embracing loop 7 are secured together with the guide loop 10 having two paths for the neck embracing loop 7 to pass through. In a second embodiment as shown in FIG. 2*b* one end of the neck embracing loop 7 is secured 23 (eg. stitched) to the back of the knot segment 4 (inner knot part 13) and the other end 18 of the neck embracing loop 7 extends through the guide loop 10 and through the opening 5 in the knot segment 4. The necktie can also have a label loop 17 attached to the inner side of the front wide flap segment 3 which is used to secure the loose lower end 18 of the neck embracing loop 7. The label loop 17 commonly will have a trademark of the manufacturer or designer printed thereon (herein the registered trademark AFTER SIX is depicted).

Referring to FIGS. 1–9 a process is provided for forming the preknotted adjustable necktie 1.

Figure 4:
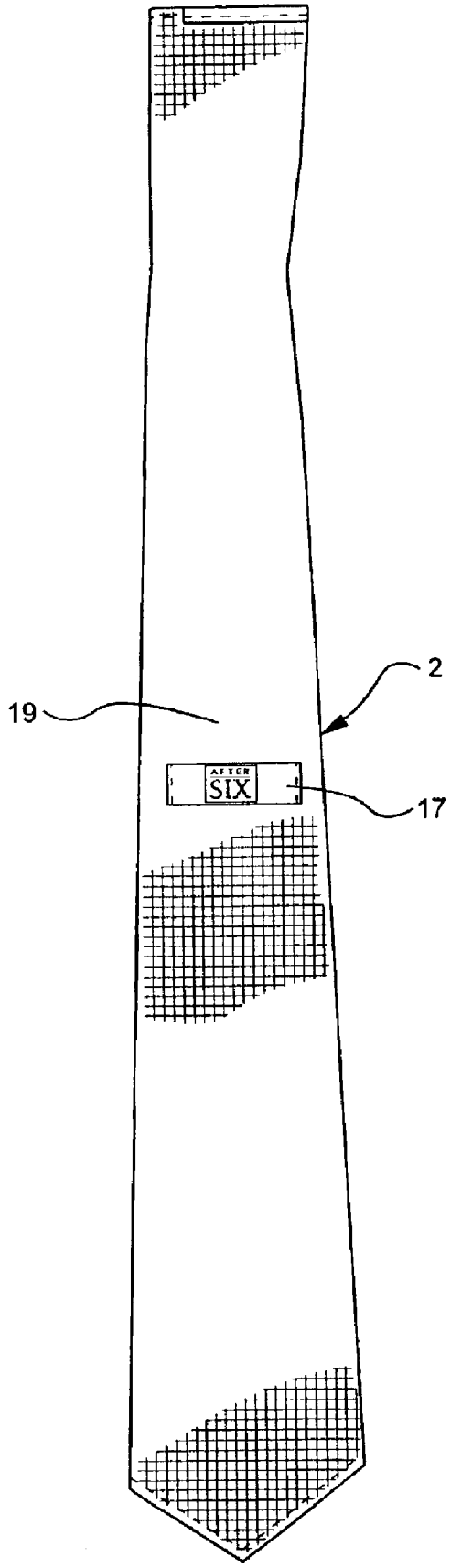
FIG. 4 is a front view of the process step wherein the stitched pattern of FIG. 4*a* has been turned inside out to form the elongated tie shaped strip of the first outer tie portion.
Figure 4A:
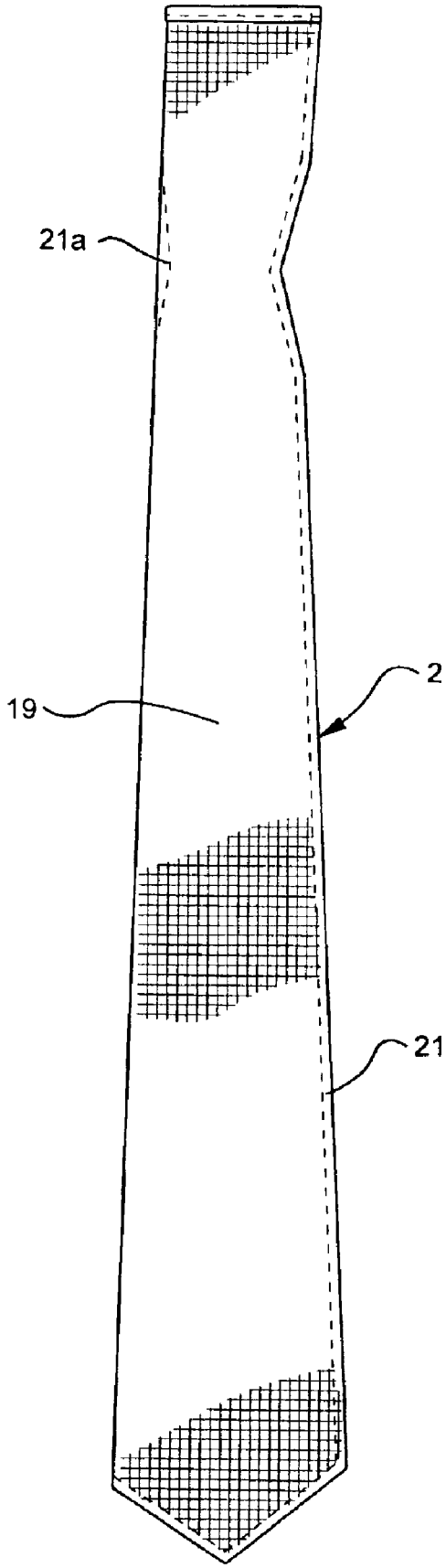
FIG. 4*a* is a front view of the process step wherein the edges of the pattern of FIG. 3 have been secured together.
Figure 8:
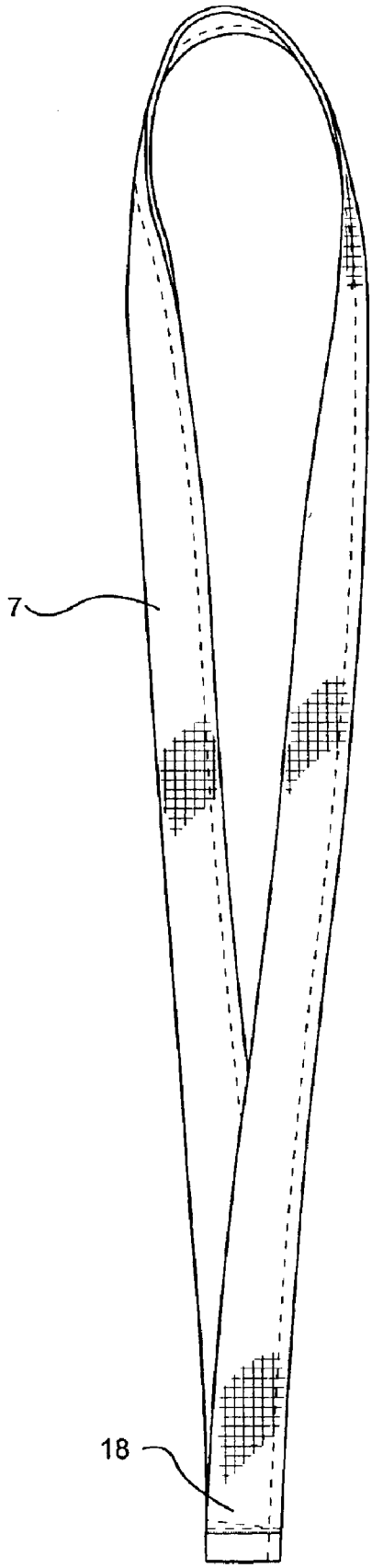
FIG. 8 is a front view of the neck embracing loop.
Figure 9:
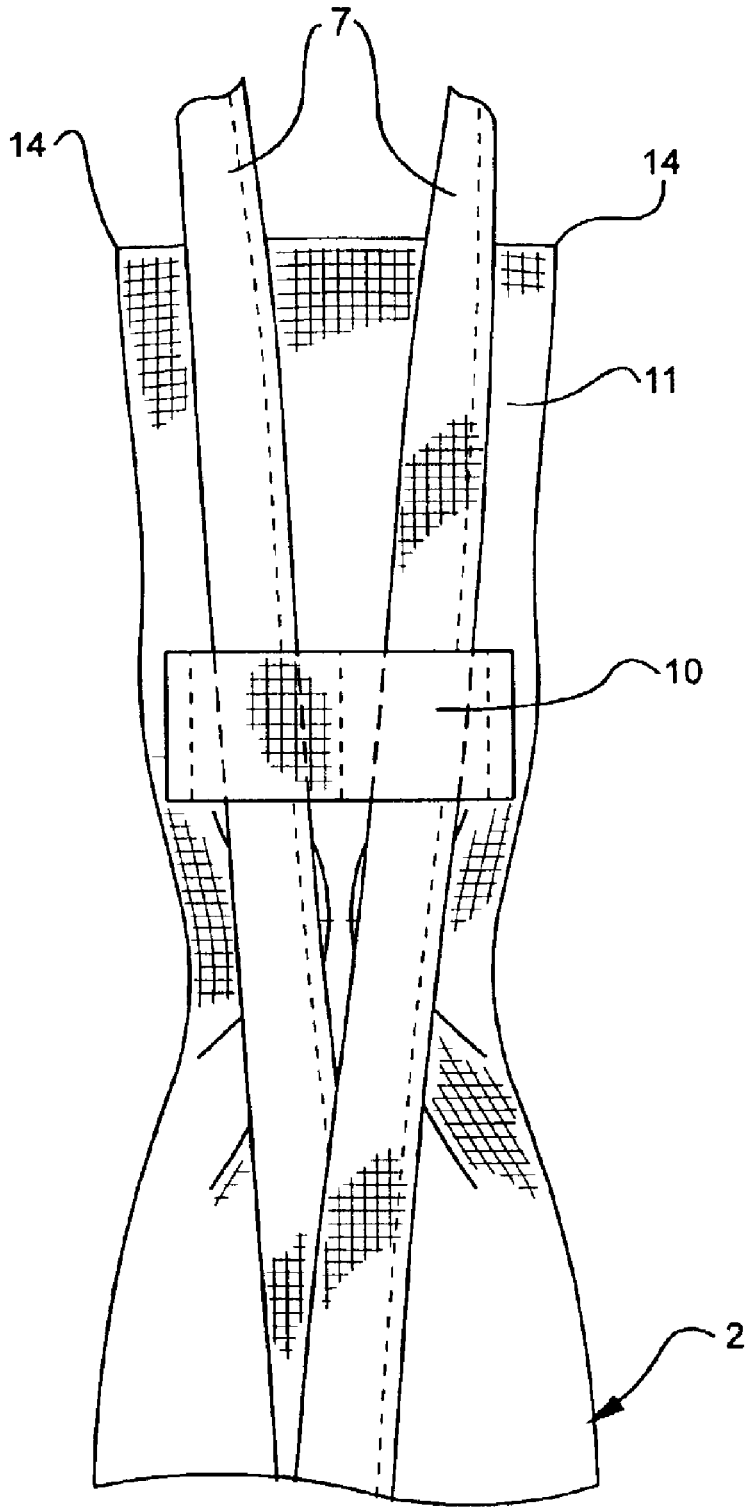
FIG. 9 is a partial rear view of the process step wherein a neck embracing loop is inserted into the formed guide loop.

The first step involves forming from a fabric material the first outer tie portion 2 as an elongated tie shaped strip 19 (see FIG. 4) and a second inner tie portion as a neck embracing loop 7 (see FIG. 8). The elongated tie shaped strip 19 is formed by cutting a pattern 20 (see FIG. 3) from the fabric material then folding the pattern 20 in half with the pattern side of the fabric facing in, then securing the edges 21 together and stitching 21*a* to provide form (see FIG. 4*a*) followed by turning the shaped strip 19 of FIG. 4*a* inside out and pressing to provide the shaped strip 19 of FIG. 4.

To provide bulk and form to the knot segment preferably the top section 11 is formed by folding over a top part of the first outer tie portion 2 and securing the folded part to a lower part of the outer tie portion by stitching 16 to form the top section 11 (see FIG. 5).

As shown in FIG. 6 to provide a desirable appearance to the knot segment preferably a longitudinal dimple (crease) 15 is created below the top section 11 of the outer tie portion 2. This dimple is secured by stitching the fabric together. At this point the guide loop 10 can be attached to the inner knot part 13 by stitching the outside edge of a piece of guide fabric strip 22 (see FIG. 7) to the back of the top section 11. For the embodiment shown in FIG. 2 the neck embracing loop 7 is inserted into the guide loop or for the embodiment shown in FIG. 2*b* one end of the neck embracing loop is secured 23 to the back of the knot segment 4 (inner knot part 13) with the other inserted into the guide loop. Then the guide loop 10 is formed by attaching inner sections of the guide fabric strip 22 to the inner knot part 13 to create the guide loop 10 having two snugly fitted paths for the neck embracing loop to pass through as in FIG. 2 or one path as in FIG. 2*b*.

The knot segment 4 is completed by folding the top section 11 of the first outer tie portion 2 to form a knot cover 12 folded over an inner knot part 13 and attaching the corners 14 of the knot cover 12 together over the dimple 15 to form an oval shaped lower end 9 of the knot segment 4 with an opening 5 therethrough and a bow shaped top end 13 of the knot segment 4.

It should be understood that the order of the process steps can be varied to produce the preknotted adjustable fabric necktie. For example, the guide loop 10 can be inserted after the knot cover 12 is folded over the inner knot part 13, or the guide loop 10 can be formed and then the neck embracing loop 7 is inserted, followed by stitching the ends of the neck embracing loop together (as in FIG. 2) or stitching one end to the inner knot part 13 (FIG. 2*b*).

What is claimed is:

1. A preknotted adjustable necktie comprising: a first outer tie portion having a front wide flap segment and a knot segment with an opening therethrough; and a second inner tie portion having an adjustable neck embracing loop extending through the opening in said knot segment, wherein the first outer tie portion and the second inner tie portion are formed of fabric material and contain no rigid materials, wherein there is a longitudinal dimple below the top section of the first outer portion and the knot segment is attached over the dimple.

2. Necktie of claim 1 wherein the knot segment has a triangular shaped front face with a bow shaped top end and an oval shaped lower end with the opening through the oval shaped lower end.

3. Necktie of claim 2 further comprising a guide loop attached to a back of the top end of the knot segment for guiding the neck embracing loop through the opening in the lower end of the knot segment.

4. Necktie of claim 3 wherein the knot segment is a knot cover folded over an inner knot part and wherein the knot cover is attached together to form the oval shaped lower end of the knot segment.

5. Necktie of claim 3, wherein ends of the neck embracing loop are secured together.

6. Necktie of claim 3, wherein one end of the neck embracing loop is attached to the back of the knot segment and the other end extends through the guide loop and the opening in the lower end of the knot segment.

7. Necktie of claim 1 wherein the opening in the knot segment and the guide loop are sized to snugly fit the neck embracing loop therethrough in order to allow for manual adjustment of the position of the knot segment on the neck embracing loop whereas otherwise the knot segment is in a secure position on the neck embracing loop.

8. Necktie of claim 7 wherein the guide loop is comprised of a non slip fabric.

9. Necktie of claim 7 further comprising a label loop attached to an inner side of the front wide flap segment.

* * * * *